US010522282B2

(12) United States Patent
Leong et al.

(10) Patent No.: US 10,522,282 B2
(45) Date of Patent: Dec. 31, 2019

(54) HIGH ISOLATION INTEGRATED INDUCTOR AND METHOD THEREOF

(71) Applicant: Realtek Semiconductor Corp., Hsinchu (TW)

(72) Inventors: Poh-Boon Leong, Pleasanton, CA (US); Chia-Liang (Leon) Lin, Fremont, CA (US)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 162 days.

(21) Appl. No.: 15/481,691

(22) Filed: Apr. 7, 2017

(65) Prior Publication Data

US 2018/0294089 A1 Oct. 11, 2018

(51) Int. Cl.
*H01F 27/28* (2006.01)

(52) U.S. Cl.
CPC ..... *H01F 27/2804* (2013.01)

(58) Field of Classification Search
CPC ..... H01F 27/2804; H01F 41/041
USPC ..... 336/200, 232
See application file for complete search history.

(56) References Cited

U.S. PATENT DOCUMENTS

| | | | | |
|---|---|---|---|---|
| 7,327,555 | B2 | 2/2008 | Yeh et al. | |
| 7,612,645 | B2 | 11/2009 | Yeh et al. | |
| 2006/0038635 | A1* | 2/2006 | Richiuso | H01F 17/0006 333/177 |
| 2008/0084255 | A1* | 4/2008 | El Rai | H01F 17/0006 333/185 |
| 2010/0033290 | A1* | 2/2010 | Liu | H01F 17/0013 336/200 |
| 2013/0249646 | A1* | 9/2013 | Mizoguchi | H03H 7/09 333/185 |
| 2013/0278372 | A1* | 10/2013 | Stecher | H01L 23/5227 336/200 |
| 2017/0012601 | A1 | 1/2017 | Yen | |

* cited by examiner

*Primary Examiner* — Tszfung J Chan
(74) *Attorney, Agent, or Firm* — McClure, Qualey & Rodack, LLP

(57) ABSTRACT

An inductor having a first coil of metal trace configured in an open loop topology and placed in a first metal layer; a second coil of metal trace configured in an open loop topology and placed in the first metal layer; and a third coil of metal trace configured in a closed loop topology and placed in a second metal layer, wherein: the first coil of metal trace is laid out to be substantially symmetrical with respect to a first axis, the second coil of metal trace is laid out to be approximately a mirror image of the first coil of metal trace with respect to a second axis, and the third coil of metal trace is laid out to enclose a majority portion of both the first coil of metal trace and the second coil of metal trace from a top view perspective.

10 Claims, 2 Drawing Sheets

HIGH ISOLATION INTEGRATED INDUCTOR AND METHOD THEREOF

BACKGROUND OF THE INVENTION

Field of the Invention

The present invention generally relates to inductors.

Description of Related Art

Inductors are widely used in many applications. A recent trend is to include a plurality of inductors on a single chip of integrated circuits. An important issue of a co-existence of multiple inductors on a single chip of integrated circuits is: there might exist an undesired magnetic coupling among said multiple inductors that is detrimental to a function of the integrated circuits. To alleviate the undesired magnetic coupling among multiple inductors, a sufficiently large physical separation between any of two inductors is often needed. This leads to a need to enlarge a total area and thus a cost of said integrated circuits.

What is disclosed is a method for constructing an inductor that is inherently less susceptible to a magnetic coupling with other inductors fabricated on the same chip of integrated circuits.

BRIEF SUMMARY OF THIS INVENTION

In an embodiment, an inductor includes: a first coil of metal trace configured in an open loop topology and placed in a first metal layer; a second coil of metal trace configured in an open loop topology and placed in the first metal layer; and a third coil of metal trace configured in a closed loop topology and placed in a second metal layer, wherein: the first coil of metal trace is laid out to be at least fairly symmetrical with respect to a first axis, the second coil of metal trace is laid out to be approximately a mirror image of the first coil of metal trace with respect to a second axis, and the third coil of metal trace is laid out to enclose a majority portion of both the first coil of metal trace and the second coil of metal trace from a top view perspective. In an embodiment, the first coil of metal trace includes an opening located on a side farthest away from the second axis. In an embodiment, the inductor is housed by a dielectric slab. In an embodiment the dielectric slab is placed on a silicon substrate. In an embodiment, another inductor is also fabricated upon the same silicon substrate.

In an embodiment, a method includes: incorporating a first coil of metal trace, configured in an open loop topology, constructed in a first metal layer, and laid out to be at least fairly symmetrical with respect to a first axis; incorporating a second coil of metal trace, configured in an open loop topology, constructed in the first metal layer, and laid out to be approximately a mirror image of the first coil of metal trace with respect with a second axis; and incorporating a third coil of metal trace, configured in a closed loop topology, constructed in a second metal layer, and laid out to enclose a majority portion both the first coil of metal trace and the second coil of metal trace from a top view perspective. In an embodiment, the first coil of metal trace includes an opening located on a side farthest away from the second axis. In an embodiment, the inductor is housed by a dielectric slab. In an embodiment the dielectric slab is placed on a silicon substrate. In an embodiment, another inductor is fabricated upon the same silicon substrate.

DETAILED DESCRIPTION OF THIS INVENTION

The present invention relates to inductors. While the specification describes several example embodiments of the invention considered favorable modes of practicing the invention, it should be understood that the invention can be implemented in many ways and is not limited to the particular examples described below or to the particular manner in which any features of such examples are implemented. In other instances, well-known details are not shown or described to avoid obscuring aspects of the invention.

Persons of ordinary skill in the art understand terms and basic concepts related to microelectronics that are used in this disclosure, such as "voltage," "current," "signal," "differential signal," "the Lenz law," "inductor," "self-inductance," "mutual inductance," "dielectric," "substrate," and "silicon chip."

Figure 1:
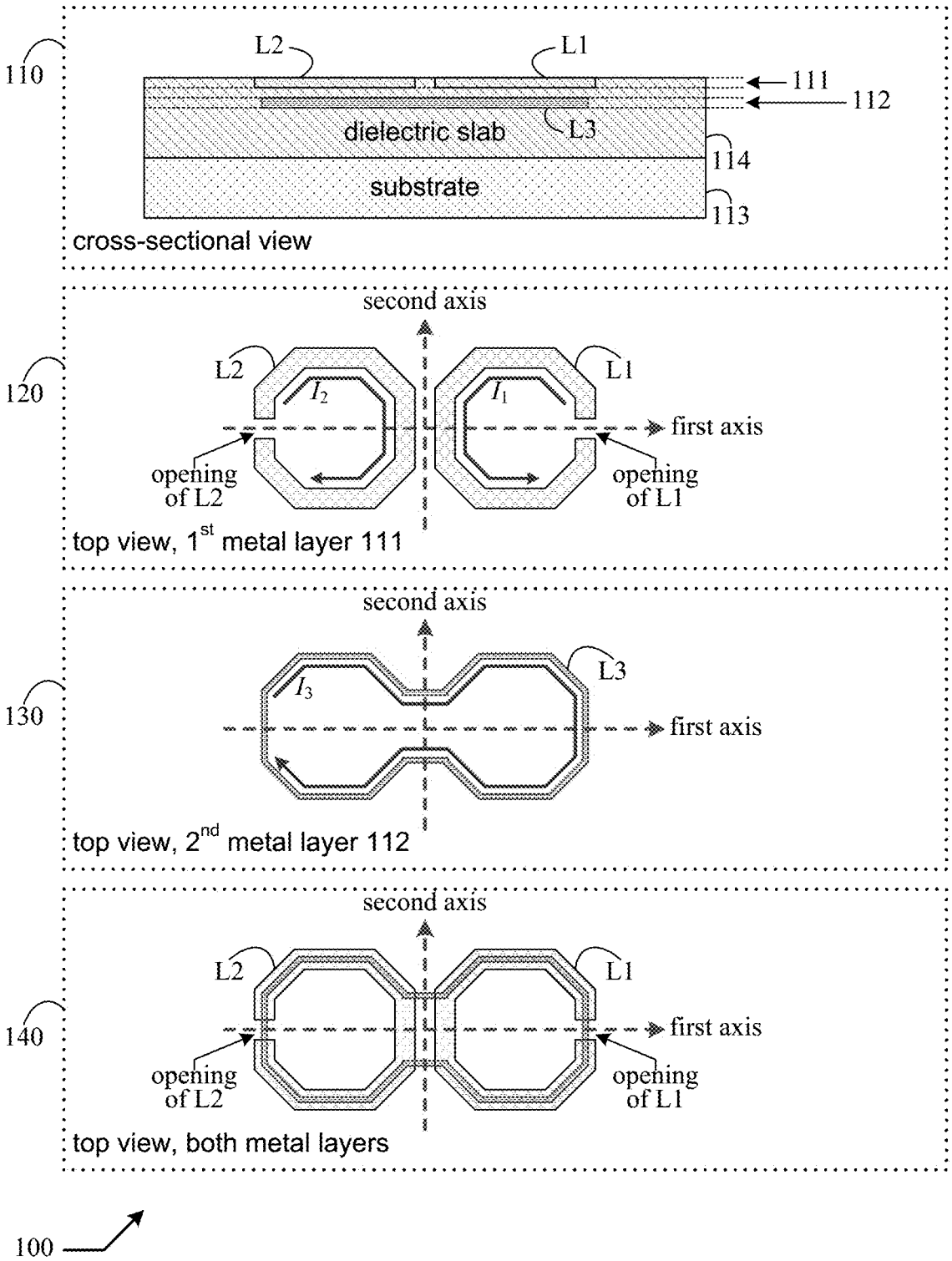
FIG. 1 shows a layout of an inductor in accordance with an embodiment of the present invention.

In accordance with an embodiment of the present invention, a layout of an inductor 100 is shown in FIG. 1. The inductor 100 is fabricated on a silicon substrate 113 and includes a first coil of metal trace L1, a second coil of metal trace L2, and a third coil of metal trace L3. For brevity, hereafter the first (second, third) coil of metal trace L1 (L2, L3) is simply referred to as L1 (L2, L3). As shown in a cross-sectional view 110, L1 and L2 are placed within a first metal layer 111, while L3 is placed within a second metal layer 112. A dielectric slab 114 placed on top of the substrate 113 serves as a housing for securing the placement of L1, L2, and L3. As shown in a top view 120 of the first metal layer 111, L1 is laid out to be substantially symmetrical with respect to a first axis, while L2 is laid out to be a mirror image of L1 with respect to a second axis. Both L1 and L2 are open loops and each of them has a narrow opening. For L1, the narrow opening is on the right hand side. For L2, the narrow opening is on the left hand side. As shown in a top view 130 of the second metal layer 112, L3 is laid out to be substantially symmetrical with respect to both the first axis and the second axis. Unlike L1 and L2, L3 is a closed loop without an opening. As shown in a top view 140 of both metal layers, L3 encloses a majority portion of both L1 and L2 from the top view perspective, although L3 is placed in a different metal layer.

Now refer to the top view 120 of the first metal layer 111. Consider a current flowing along L1 in a counterclockwise direction be $I_1$. Also consider a current flowing along L2 in a clockwise direction be $I_2$. It is convenient to rewrite $I_1$ and $I_2$ as follows:

$$I_1=I_{even}+I_{odd} \tag{1}$$

$$I_2=I_{even}-I_{odd}, \tag{2}$$

where $$I_{even}=(I_1+I_2)/2 \tag{3}$$

$$I_{odd}=(I_1-I_2)/2. \tag{4}$$

Here, $I_{even}$ is an even-mode current-mode signal that represents a symmetrical component in $I_1$ and $I_2$, while $I_{odd}$ is an odd-mode current-mode signal that represents an anti-symmetrical component in $I_1$ and $I_2$.

Now refer to the top view 130 of the second metal layer 112. Let a current following along L3 in a clockwise direction be $I_3$. Now refer to the top view 140 of both metal layers, along with referring to the aforementioned definitions of $I_1$, $I_2$, $I_3$, $I_{even}$, and $I_{odd}$. According to Lenz law, an increase of $I_1$ will lead to an increase of $I_3$ due to a common magnetic flux shared by both L1 and L3. On the other hand, an increase of $I_2$ will lead to a decrease of $I_3$ due to a common magnetic flux shared by both L2 and L3. When both $I_1$ and $I_2$ change by the same amount, incidentally resulting in a change on $I_{even}$ (see equation (3)), it leads to no change on $I_3$, since the effects of inductions on $I_3$ from $I_1$ and $I_2$, respectively, cancel each other in this even-mode scenario. In contrast, when h and $I_2$ change by an opposite amount, incidentally resulting in a change on $I_{odd}$ (see equation (3)), it leads to a reinforced change on $I_3$, since the effects of inductions on $I_3$ from $I_1$ and $I_2$, respectively, reinforce each other in this odd-mode scenario. In other words, $I_3$ is responsive to $I_{odd}$, but not $I_{even}$. Conversely, a change on $I_3$ will lead to a change on $I_{odd}$ but no change on $I_{even}$.

With the above explanations in mind, a user can use inductor 100 to perform a mode selection function. As explained earlier, the existence of L3 has no effect on $I_{even}$, but a profound effect on $I_{odd}$. In particular, the Lenz law will impede a change on $I_{odd}$ due to the existence of L3, since a change in a magnetic flux due to a change on $I_{odd}$ will lead to a change on $I_3$ that will oppose the change in the magnetic flux and thus undermine the change on $I_{odd}$. As a result, the change on $I_{odd}$ will be greatly impeded. Therefore, the even mode signal $I_{even}$ can remain intact, while the odd mode signals $I_{odd}$ can be suppressed in the presence of L3.

In case of an undesired magnetic coupling from inductor 100 to an another inductor residing on the same silicon chip, the undesired magnetic coupling from L1 to said another inductor will be opposed by the undesired magnetic coupling from L2 to said another inductor, since $I_1$ and $I_2$ are substantially the same (thanks to the aforementioned mode selection function) but they physically flow in opposite directions (i.e. one of them is clockwise, while the other one is counterclockwise). The inductor 100, therefore, can effectively mitigate the undesired magnetic coupling, and thus can be highly isolated from other inductances that coexist on the same silicon chip.

By way of example but not limitation, both L1 and L2 are of a dimension of 160 μm by 160 μm; a trace width is 20 μm for both L1 and L2; a physical separation between L1 and L2 is 20 μm; the opening is 20 μm wide for both L1 and L2; a trace width of L3 is 5 μm; a thickness of the first metal layer 111 is 3.2 μm; a thickness of the second metal layer 112 is 0.4 μm; a dielectric constant of the dielectric slab 114 is 4.1.

Although it is preferred that the inductor 100 is laid out to be exactly symmetrical (i.e., L1 is laid out to be exactly symmetrical with respect to the first axis, L2 is laid out to be an exact mirror image of L1 with respect to the second axis, and L3 is laid out to be exactly symmetrical with respect to both the first axis and the second axis), an exact symmetry is desirable but not absolutely necessary. An inductor designer might choose to lay out the inductor 100 to be not highly symmetrical for whatever reason, but lack of a high degree of symmetry might lead to an appreciable degradation in the performance of aforementioned functions of mode selection and isolation. To have a reasonably good performance, the layout needs to be at least fairly symmetrical.

Note that for both L1 and L2, the opening is deliberately configured to be on a side that is farthest away from the second axis. Such arrangement helps to minimize an undesired magnetic coupling from inductor 100 to another inductor located at a certain point along the first axis. If said another inductor is placed on the right (left) side of the second axis, the coupling from L1 (L2) to said another inductor will be greater than the coupling from L2 (L1) to said another inductor thanks to a shorter distance; the disparity between the two coupling degrades the isolation between inductor 100 and said another inductor. However, by deliberately configuring the opening to be on a side that is farthest away from the second axis for both L1 and L2, the disparity can be minimized. The key is: an opening of a coil does not generate a magnetic flux due to the absence of metal, and consequently cannot contribute to a magnetic coupling. If said another inductor is placed on the right (left) side of the second axis, the coupling from L1 (L2) to said another inductor is minimized due to that the opening of L1 (L2), which contributes nothing to magnetic coupling, is located at a part of L1 (L2) that is closest to said another inductor. In other words, the part of inductor 100 that is closest to said another inductor and thus can potentially make a greatest contribution to the undesired coupling is deliberately deprived of its ability to generate a magnetic flux in the first place.

Figure 2:
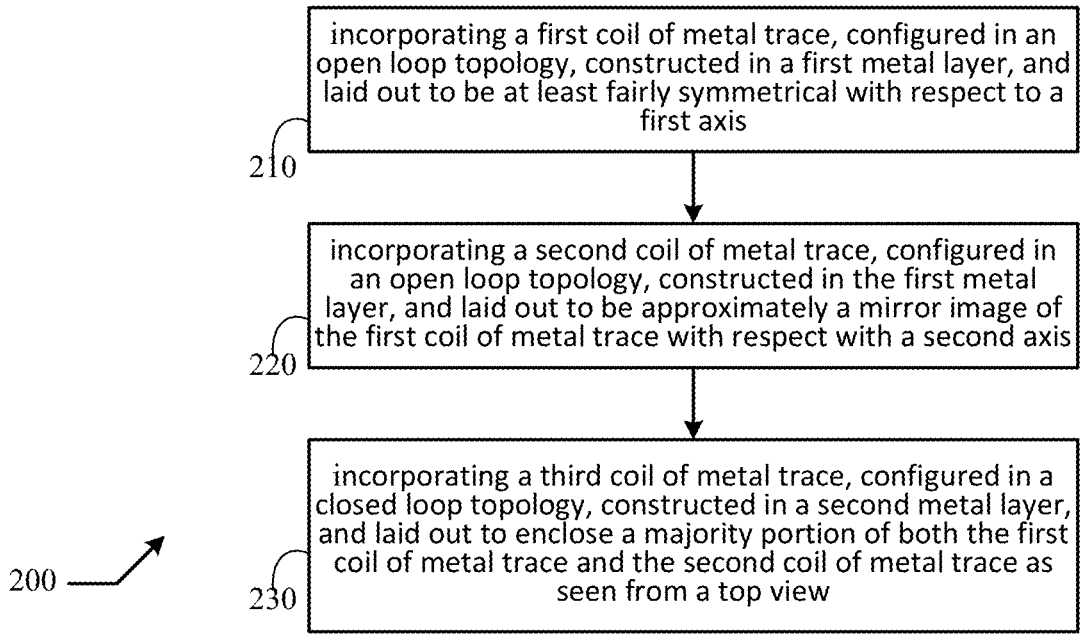
FIG. 2 shows a flow diagram in accordance with an embodiment of the present invention.

In an embodiment illustrated by a flow diagram 200 shown in FIG. 2, a method comprises: (step 210) incorporating a first coil of metal trace, configured in an open loop topology, constructed in a first metal layer, and laid out to be fairly symmetrical with respect to a first axis; (step 220) incorporating a second coil of metal trace, configured in an open loop topology, constructed in the first metal layer, and laid out to be approximately a mirror image of the first coil of metal trace with respect with a second axis; and (step 230) incorporating a third coil of metal trace, configured in a closed loop topology, constructed in a second metal layer, and laid out to be approximately enclosing both the first coil of metal trace and the second coil of metal trace from a top view perspective.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An inductor comprising:

a first coil of metal trace configured in an open loop topology and placed in a first metal layer;

a second coil of metal trace configured in an open loop topology and placed in the first metal layer; and a third coil of metal trace configured in a closed loop topology and placed in a second metal layer, wherein: the first coil of metal trace is laid out to be substantially symmetrical with respect to a first axis, the second coil of metal trace is laid out to be approximately a mirror image of the first coil of metal trace with respect to a second axis, and the third coil of metal trace is laid out to enclose a majority portion of both the first coil of metal trace and the second coil of metal trace from a top view perspective.

2. The inductor of claim 1, wherein the first coil of metal trace includes an opening located on a side farthest away from the second axis.

3. The inductor of claim 1, wherein the inductor is housed by a dielectric slab.

4. The inductor of claim 3, wherein the dielectric slab is placed on a silicon substrate.

5. The inductor of claim 4, wherein another inductor is also fabricated upon the same silicon substrate.

6. A method comprising:

incorporating a first coil of metal trace, configured in an open loop topology, constructed in a first metal layer, and laid out to be substantially symmetrical with respect to a first axis;

incorporating a second coil of metal trace, configured in an open loop topology, constructed in the first metal layer, and laid out to be approximately a mirror image of the first coil of metal trace with respect with a second axis; and incorporating a third coil of metal trace, configured in a closed loop topology, constructed in a second metal layer, and laid out to enclose a majority portion of both the first coil of metal trace and the second coil of metal trace from a top view perspective.

7. The method of claim 6, wherein the first coil of metal trace includes an opening located on a side farthest away from the second axis.

8. The method of claim 6, wherein the inductor is housed by a dielectric slab.

9. The method of claim 8, wherein the dielectric slab is placed on a silicon substrate.

10. The method of claim 9, wherein another inductor is also fabricated upon the same silicon substrate.

* * * * *